US011011871B2

(12) United States Patent
Fujiwara et al.

(10) Patent No.: US 11,011,871 B2
(45) Date of Patent: May 18, 2021

(54) CONNECTOR FOR DIFFERENT CONNECTION TYPES

(71) Applicant: OMRON Corporation, Kyoto (JP)

(72) Inventors: Taijiro Fujiwara, Okayama (JP); Hirokazu Hoshino, Okayama (JP); Masao Nagase, Wake-gun (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 16/641,248

(22) PCT Filed: Mar. 6, 2019

(86) PCT No.: PCT/JP2019/008732

§ 371 (c)(1),
(2) Date: Feb. 23, 2020

(87) PCT Pub. No.: WO2019/176663

PCT Pub. Date: Sep. 19, 2019

(65) Prior Publication Data

US 2020/0227861 A1 Jul. 16, 2020

(30) Foreign Application Priority Data

Mar. 14, 2018 (JP) ..... JP2018-047285

(51) Int. Cl.
*H01R 13/622* (2006.01)
*H01R 13/631* (2006.01)
*H01R 13/639* (2006.01)

(52) U.S. Cl.
CPC ..... *H01R 13/622* (2013.01); *H01R 13/631* (2013.01); *H01R 13/639* (2013.01)

(58) Field of Classification Search
CPC .... H01R 13/62; H01R 13/622; H01R 13/625; H01R 13/6273; H01R 13/6277; H01R 13/631; H01R 13/639
See application file for complete search history.

(56) References Cited

U.S. PATENT DOCUMENTS 7,695,302 B2 4/2010 Eissner et al.
9,559,458 B2 * 1/2017 Zhang ..... H01R 13/623
(Continued)

FOREIGN PATENT DOCUMENTS

CN 101976786 A 2/2011
CN 105322347 A 2/2016
(Continued)

OTHER PUBLICATIONS

An English translation of the International Search Report("ISR") of PCT/JP2019/008732 dated May 28, 2019.
(Continued)

*Primary Examiner* — Oscar C Jimenez
(74) *Attorney, Agent, or Firm* — Metrolex IP Law Group, PLLC

(57) ABSTRACT

A connector is provided with a locking portion having hook portions extending in the first direction, arranged at intervals around the first direction, and capable of being resilient deformation in a second direction intersecting the first direction and away from the connector main body, and a holding portion having a tubular shape encircling the locking portion around the first direction and having a screw groove portion provided on an inner peripheral surface at an end portion in the first direction and adjacent to a connection portion. The holding portion is moveable between a holding position where the holding portion holds the locking portion locked to a to-be-locked portion of a first mating connector, a hold releasing position where the holding portion releases the holding of the locking portion, and a fitting position where the screw groove portion is fitted to a screw thread portion of a second mating connector.

7 Claims, 7 Drawing Sheets

(56) References Cited

U.S. PATENT DOCUMENTS

| | | | | |
|---|---|---|---|---|
| 10,651,574 | B2 * | 5/2020 | Maroney | H01R 13/6583 |
| 10,651,593 | B2 * | 5/2020 | Wu | H01R 13/623 |
| 2007/0105417 | A1 | 5/2007 | Camelio | |
| 2010/0105235 | A1 * | 4/2010 | Friedrich | H01R 13/622<br>439/321 |
| 2013/0323967 | A1 * | 12/2013 | Wood | H01R 9/0524<br>439/583 |
| 2015/0372417 | A1 | 12/2015 | Dieduksman et al. | |
| 2019/0058284 | A1 | 2/2019 | Joniak et al. | |

FOREIGN PATENT DOCUMENTS

| | | | |
|---|---|---|---|
| CN | 206379497 | U | 8/2017 |
| JP | S58-026177 | U | 2/1983 |
| JP | 2016-015316 | A | 1/2016 |
| TW | I603549 | B | 10/2017 |
| WO | 2017/1477062 | A1 | 8/2017 |

OTHER PUBLICATIONS

The Written Opinion("WO") of PCT/JP2019/008732 dated May 28, 2019.

The Taiwanese Office Action (TWOA) dated Jan. 20, 2020 in a corresponding Taiwanese patent application.

The Chinese Office Action (CNOA) dated Sep. 24, 2020 in a counterpart Chinese patent application.

* cited by examiner

CONNECTOR FOR DIFFERENT CONNECTION TYPES

TECHNICAL FIELD

The present disclosure relates to a connector.

BACKGROUND ART

Patent Document 1 discloses a first connector and a second connector that can be connected to each other in a predetermined direction. The first connector includes a recess portion having a locking portion therein. Further, the second connector has a tubular shape that can be inserted into the recess of the first connector and has, on its outer peripheral surface, a to-be-locked portion to which the locking portion of the first connector can be locked.

PRIOR ART DOCUMENT

Patent Document

Patent Document 1: U.S. Pat. No. 7,695,302 B

SUMMARY OF INVENTION

Subjects to be Solved by the Invention

By the way, the first connector and the second connector are connectors of a so-called snap-fit type. In general, to such a connector of a snap-fit connection type, only a connector of a snap-fit connection type can be connected and held, so that a connector other than a connector of a snap-fit connection type cannot be connected and held, which lacks in convenience.

It is therefore an object of the present disclosure to provide a highly convenient connector capable of being connected and held with respect to a connector of a different connection type.

Means for Solving the Subjects

A connector as an example of the present disclosure capable of being locked and held with respect to a first mating connector connected in a first direction or capable of being held and fitted with respect to a second mating connector connected in the first direction, the connector includes a connector main body having a connection portion extending in the first direction, provided at a first end portion in the first direction, and capable of being connected to the first mating connector and the second mating connector, a locking portion disposed at the first end portion of the connector main body around the first direction and capable of being locked to a to-be-locked portion of the first mating connector in the first direction in a connected state where the first mating connector is connected to the connection portion, and a holding portion having a tubular shape encircling the locking portion around the first direction and moveable relative to the connector main body in the first direction, the holding portion having a screw groove portion provided on an inner peripheral surface at an end portion in the first direction and adjacent to the first end portion and capable of being fitted to a screw thread portion of the second mating connector in a connected state where the second mating connecter is connected to the connection portion, in which the locking portion has a plurality of hook portions extending in the first direction, arranged at intervals around the first direction, and capable of being locked to the to-be-locked portion through resilient deformation in a second direction intersecting the first direction and away from the connector main body, and the holding portion is moveable between a holding position where the holding portion holds the plurality of hook portions locked to the to-be-locked portion, a hold releasing position that is remote from the first end portion relative to the holding position in the first direction and where the holding portion releases the holding of the locking portion, and a fitting position that is adjacent to the first end portion of the connector main body relative to the holding position in the first direction A and where the screw groove portion is fitted to the screw thread portion.

Effects of the Invention

In the connector, the locking portion has the plurality of hook portions extending in the first direction, arranged at intervals around the first direction, and resiliently deformable in the second direction intersecting the first direction and away from the connector main body. Further, the holding portion has a tubular shape encircling the locking portion around the first direction and has the screw groove portion provided on the inner peripheral surface at the end portion adjacent to the connection portion in the first direction. The presence of the plurality of hook portions makes it possible to lock and hold the connector with respect to the first mating connector of a snap-fit connection type in the connected state, and the presence of the screw groove portion makes it possible to fit and hold the connector with respect to the second mating connector of a screw connection type in the connected state. That is, it is possible to realize the connector with high convenience that is capable of being held with respect to not only the mating connector of a snap-fit connection type but also the mating connector of a screw connection type in the connected state.

MODES FOR CARRYING OUT THE INVENTION

Hereinafter, a description will be given of an example of the present disclosure with reference to the accompanying drawings. Note that, in the following description, terms representing specific directions or positions (for example, terms including "up", "down", "right", and "left") will be used as necessary, but the use of these terms is intended to facilitate understanding of the present disclosure with reference to the drawings, and the technical scope of the present disclosure is not limited by the meanings of the terms. Further, the following description shows merely an example in nature and is not intended to limit the present disclosure, applications of the present disclosure, or uses of the present disclosure. Furthermore, the drawings are schematic drawings, and ratios between dimensions are not necessarily equal to the actual ratios.

Figure 1:
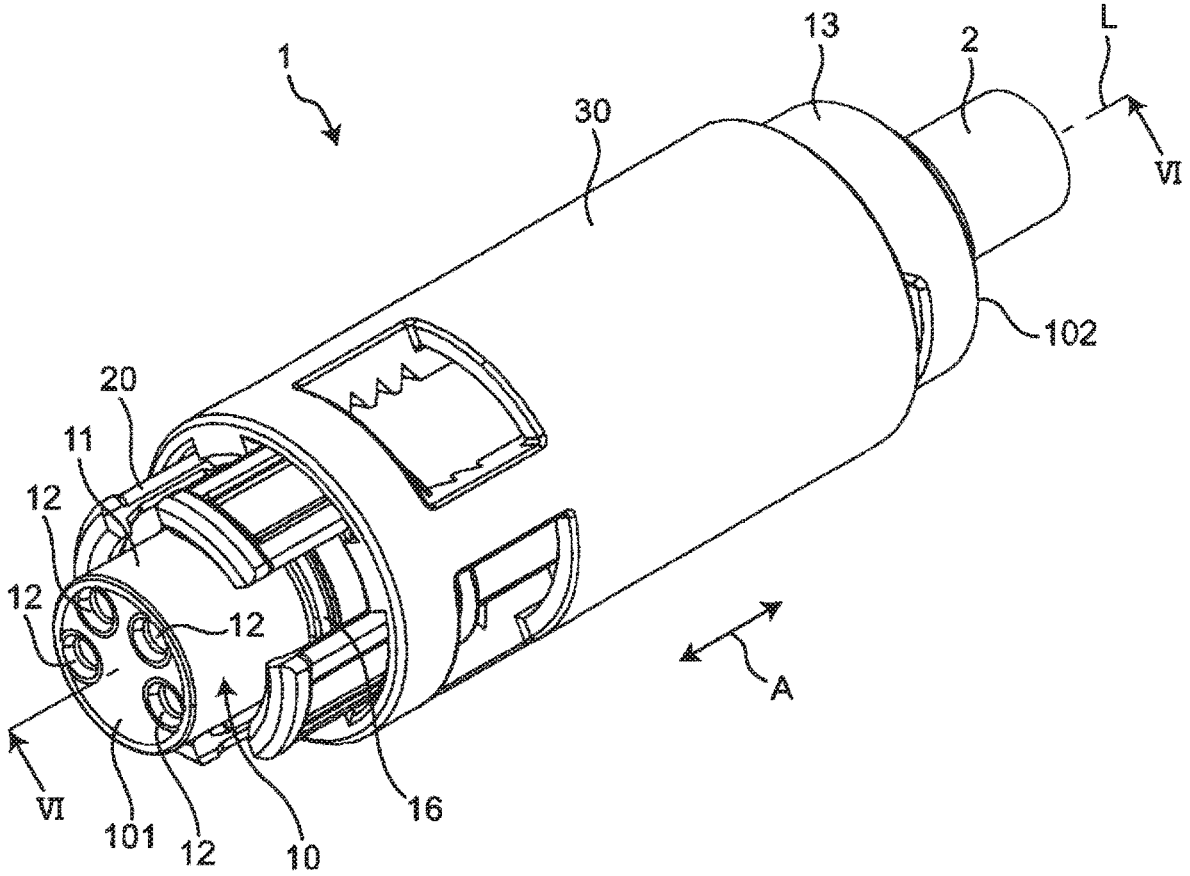
FIG. 1 is a perspective view showing a connector according to an embodiment of the present disclosure.

As shown in FIG. 1, a connector 1 according to an embodiment of the present disclosure is capable of being selectively connected and held with respect to a first mating connector of a so-called snap-fit connection type and a second mating connector of a so-called screw connection type in a first direction A. That is, the connector 1 is capable of being locked and held with respect to the first mating connector connected in the first direction A and is capable of being fitted and held with respect to the second mating connector connected in the first direction A. The connector 1 includes a connector main body 10 capable of being connected to the mating connector, a locking portion 20 disposed on the connector main body 10 around the first direction A, and a holding portion 30 on the locking portion 20 around the first direction A. The holding portion 30 is moveable in the first direction A relative to the connector main body 10.

As shown in FIG. 1, the connector main body 10 has a connection portion 11 extending in the first direction A, provided at a first end portion 101 in the first direction A, and capable of being connected to the mating connector. Further, a cable 2 having a conductor portion therein is connected to a second end portion 102 of the connector main body 10 in the first direction A. According to this embodiment, as an example, the connector main body 10 has an approximately cylinder shape and serves as a female socket.

Provided inside the connection portion 11 are a plurality of terminal receiving portions 12 into which plug terminals of the mating connector can be inserted and from which the plug terminals can be pulled out in the first direction A. Each of the terminal receiving portions 12 receives a socket terminal electrically connected to the conductor portion of the cable 2. Note that, in the connector 1, as an example, four terminal receiving portions 12 are provided in the connection portion 11.

An O-ring 16 is further provided on an outer periphery of the connection portion 11. The O-ring 16 is configured to seal a space between the connection portion 11 and the mating connector in a connected state where the mating connector is connected to the connection portion 11.

Figure 2:
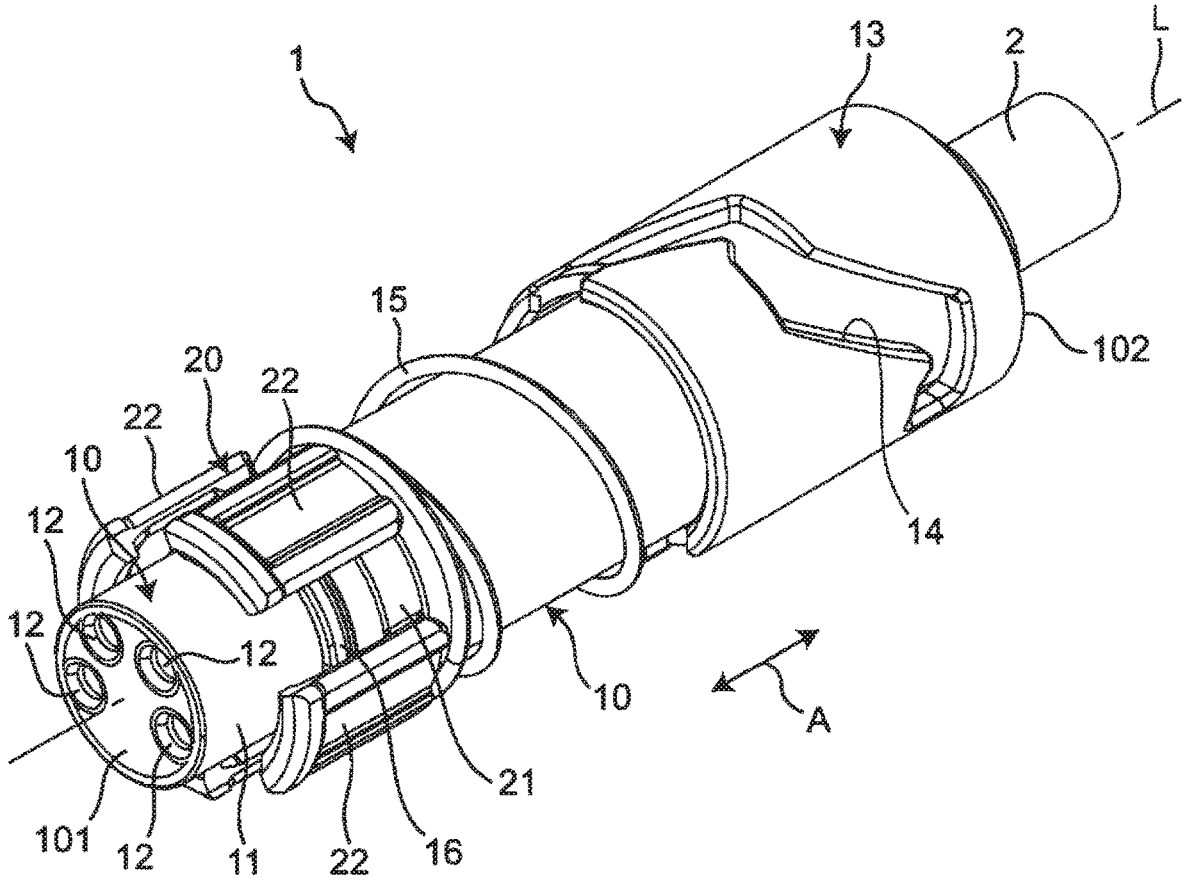
FIG. 2 is a perspective view of the connector shown in FIG. 1 with a holding portion removed.

As shown in FIG. 2, a guide portion 13 is fixed to the second end portion 102 of the connector main body 10. This guide portion 13 has a guide groove portion 14 capable of receiving a guide protrusion 32 of the holding portion 30 to be described later. The guide groove portion 14 extends, from the second end portion 102 of the connector main body 10 toward the first end portion 101 in the first direction A, in a spiral around a center line L the connector main body 10 extending in the first direction A to guide the holding portion 30 in the first direction A via the guide protrusion 32.

Note that the guide portion 13 of the connector 1 is provided with, as an example, two guide groove portions 14 symmetrically arranged with respect to the center line L of the connector main body 10.

Further, provided between the connection portion 11 and the guide portion 13 of the connector main body 10 is a coil spring 15 as an example of a resilient portion. The coil spring 15 extends and contracts in the first direction A to push the holding portion 30 in the first direction A toward a holding position P2 (see FIG. 7) to be described later.

As shown in FIG. 2, the locking portion 20 is disposed at the first end portion 101 of the connector main body 10 around the first direction A and is capable of being locked to a to-be-locked portion of the mating connector in the first direction A in the connected state where the mating connector is connected to the connection portion 11.

Specifically, the locking portion 20 includes a main body portion 21 having a ring shape encircling the connector main body 10 around the first direction A, and a plurality of hook portions 22 provided on the main body portion 21, extending in the first direction, and arranged at intervals around the first direction A. The connector 1 is provided with, as an example, four hook portions 22 arranged at equal intervals around the first direction A.

Figure 3:
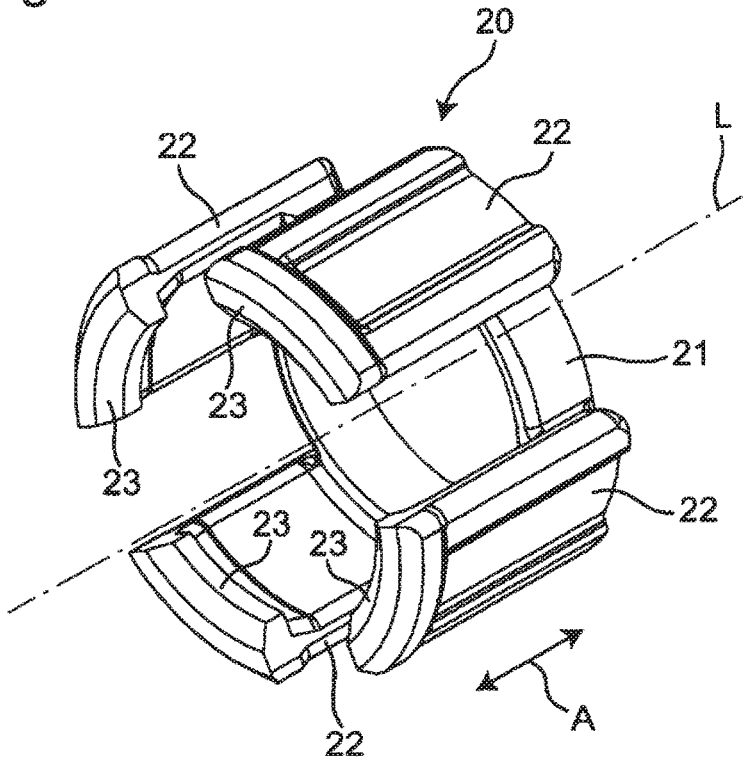
FIG. 3 is a perspective view showing a locking portion of the connector shown in FIG. 1.

Each of the hook portions 22 has, as shown in FIG. 3, an arcuate plate shape curved along an outer surface of the connector main body 10 and is resiliently deformable in a second direction intersecting the first direction A (that is, a radial direction with respect to the center line L) and away from the connector main body 10. A distal end portion of each of the hook portions 22 (that is, an end portion in the first direction A and adjacent to the first end portion 101 of the connector main body 10) has a protrusion portion 23 extending in the second direction and toward the connector main body 10. The protrusion portion 23 is capable of being locked to the to-be-locked portion in the first direction A in the connected state where the mating connector is connected to the connection portion 11.

Figure 4:
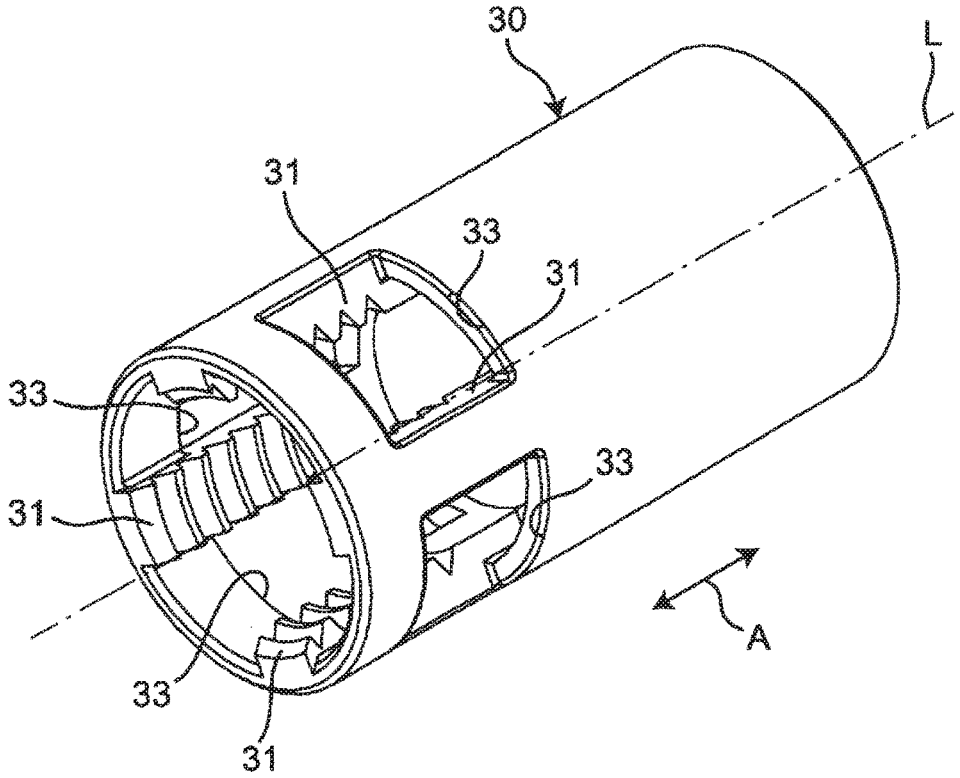
FIG. 4 is a perspective view showing the holding portion of the connector shown in FIG. 1.
Figure 5:
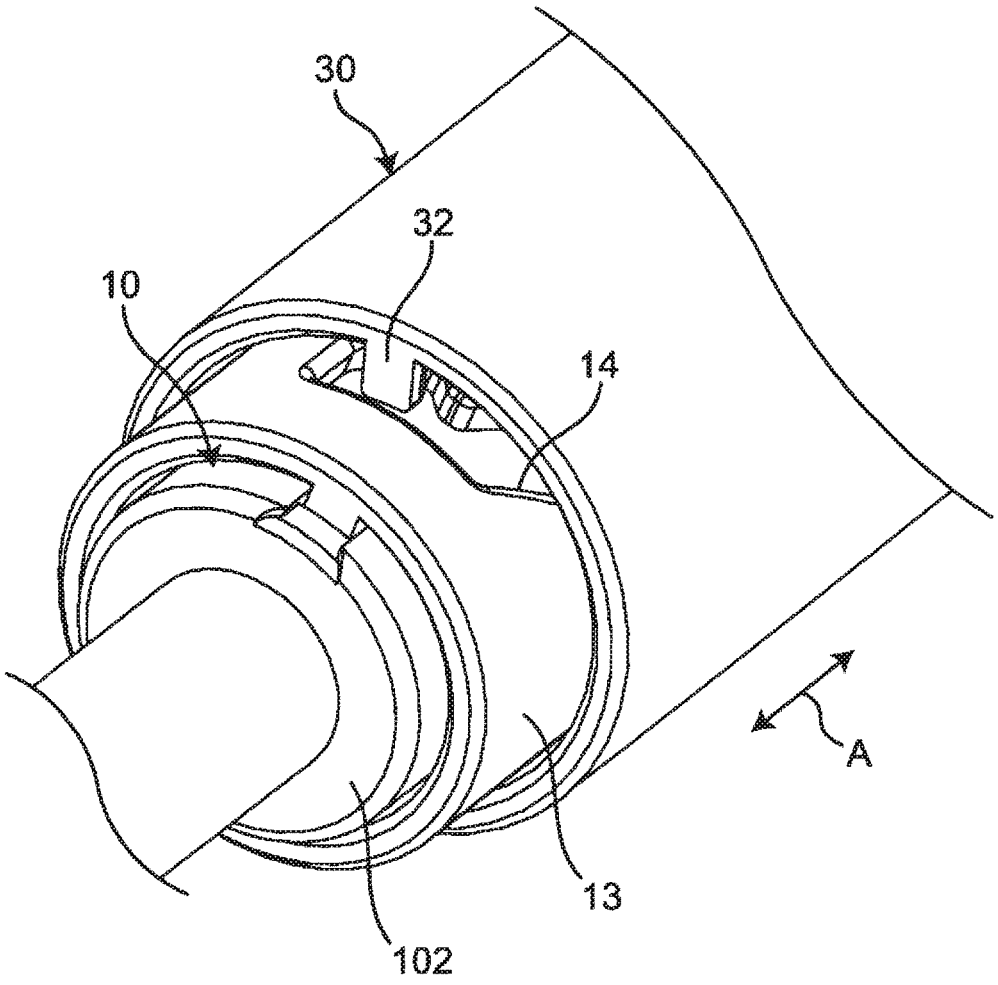
FIG. 5 is an enlarged perspective view of a second end portion of a connector main body as viewed from a direction different from the direction of FIG. 1 of the connector shown in FIG. 1.

As shown in FIG. 1, the holding portion 30 has a tubular shape (for example, an approximately cylinder shape) encircling the locking portion 20 around the first direction A. As shown in FIGS. 4 and 5, the holding portion 30 is provided with a screw groove portion 31, the guide protrusion 32, and a plurality of hook receiving portions 33.

As shown in FIG. 4, the screw groove portion 31 is provided on an inner peripheral surface of the holding portion 30 at an end portion in the first direction A and adjacent to the first end portion 101 of the connector main body 10. The connector 1 has, as an example, four screw groove portions 31 arranged at equal intervals around the center line L of the connector main body 10. Each of the screw groove portions 31 includes a plurality of screw grooves arranged at equal intervals in the first direction A.

As shown in FIG. 5, the guide protrusion 32 is disposed at an end portion in the first direction A and remote from the first end portion 101 of the connector main body 10 (that is, an end portion adjacent to the second end portion 102). The guide protrusion 32 extends in the second direction and toward the connector main body 10 and is capable of being received in the guide groove portion 14 of the guide portion 13.

Figure 8:
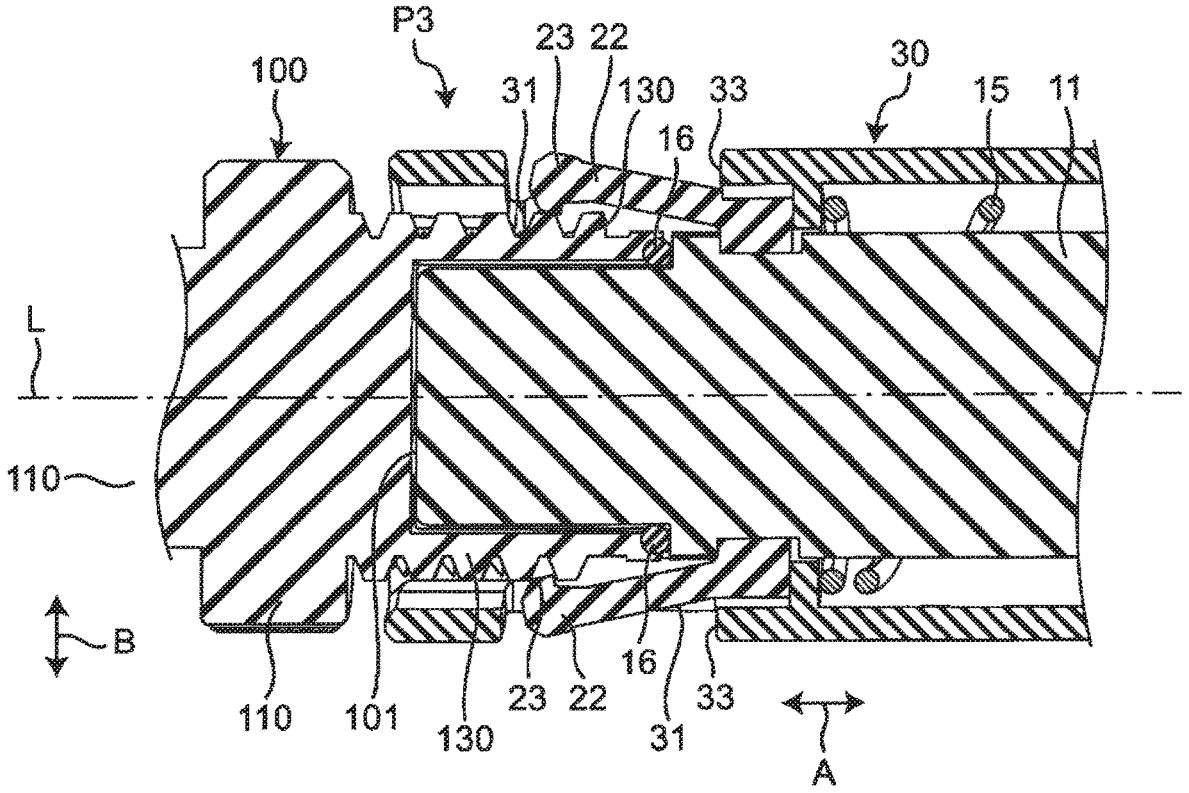
FIG. 8 is a second schematic cross-sectional view showing a state where the mating connector is connected to the connector shown in FIG. 1.

The hook receiving portions 33 are arranged on the holding portion 30 around the first direction A and are each configured by an opening portion that extends through the holding portion 30 in the second direction and is capable of receiving a corresponding one of the plurality of hook portions 22 of the locking portion 20 at a fitting position P3 (see FIG. 8). That is, in the connector 1, as an example, four hook receiving portions 33 are arranged at equal intervals around the center line L of the connector main body 10.

The screw groove portions 31 and the hook receiving portions 33 are alternately arranged in series around the center line L of the connector main body 10.

Figure 6:
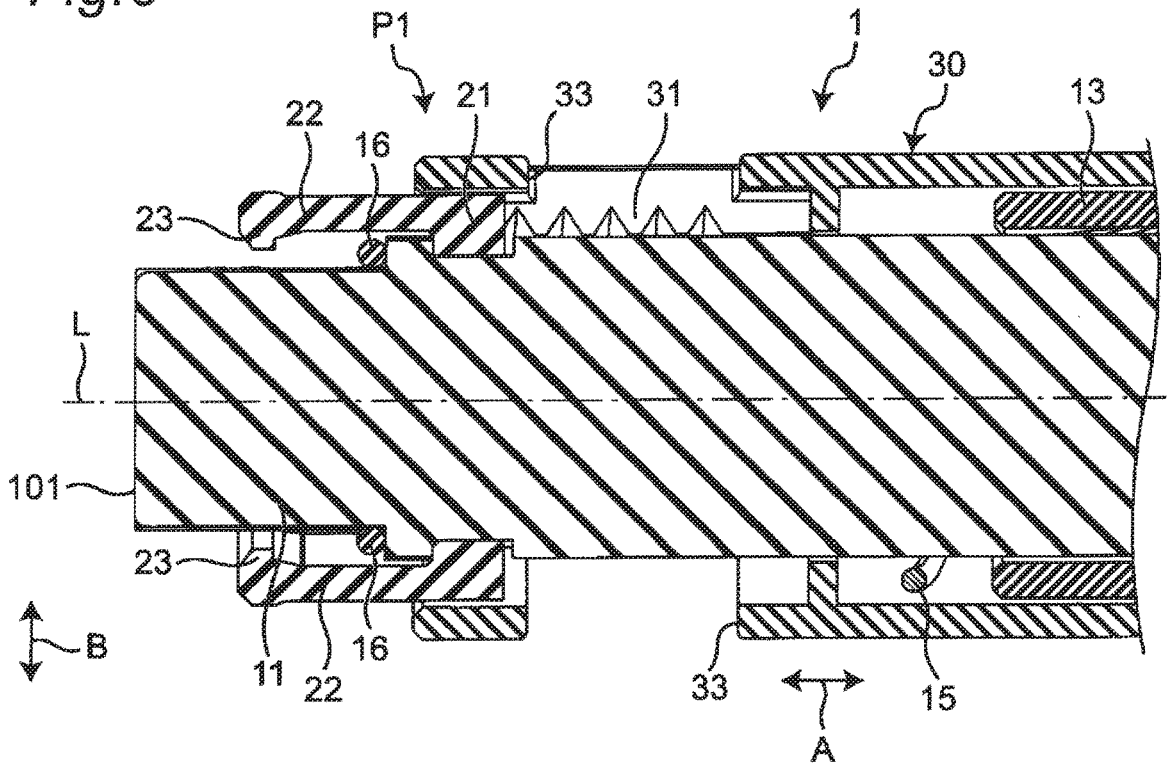
FIG. 6 is a cross-sectional view taken along a line VI-VI of FIG. 1.
Figure 7:
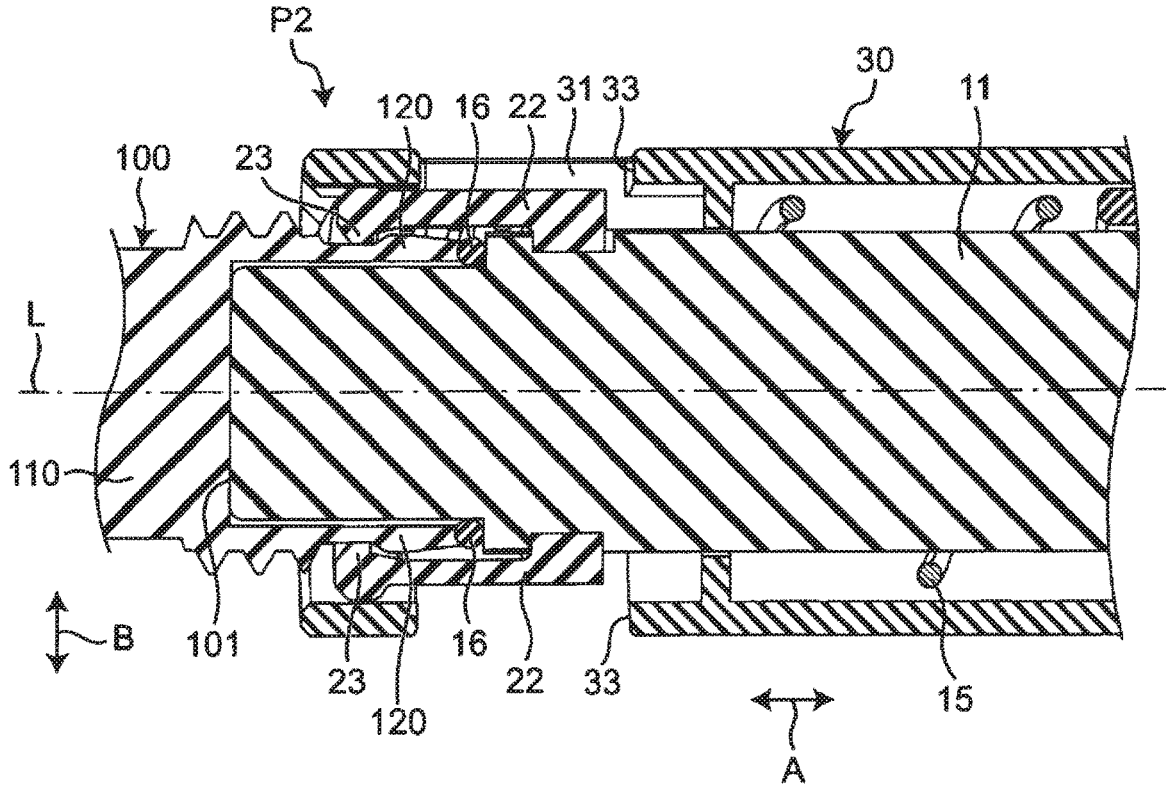
FIG. 7 is a first schematic cross-sectional view showing a state where a mating connector is connected to the connector shown in FIG. 1.

As shown in FIGS. 6 to 8, the holding portion 30 is moveable between three positions in the first direction A, that is, a hold releasing position P1, the holding position P2, and the fitting position P3. The hold releasing position P1, the holding position P2, and the fitting position P3 are arranged in this order toward the first end portion 101 of the connector main body 10.

As shown in FIG. 6, the hold releasing position P1 is a position where each of the hook portions 22 of the locking portion 20 is allowed to move in the second direction B. As shown in FIG. 7, the holding position P2 is a position where each of the hook portions 22 locked to a to-be-to-be-locked portion 120 in the first direction A is restricted in movement in the second direction and held in the connected state where the mating connector is connected to the connection portion 11. Further, as shown in FIG. 8, the fitting position P3 is a position where a screw thread portion 130 of the mating connector is fitted to the screw groove portion 31 in the connected state where the mating connector is connected to the connection portion 11.

Note that since the holding portion 30 is pushed toward the holding position P2 in the first direction A by the coil spring 15, the holding portion 30 is configured to be located at the holding position P2 in an initial state where no external force is applied.

Next, a description will be given of motion of the connector 1 when the connector 1 is connected to and held with respect to the mating connector with reference to FIGS. 6 to 8.

First, as shown in FIG. 6, a connector main body 110 of the mating connector 100 is connected to the connector main body 10 with the holding portion 30 moved to the hold releasing position P1.

When the mating connector 100 is a connector of a so-called snap-fit connection type, as shown in FIG. 7, the connector main body 110 of the mating connector 100 is connected to the connector main body 10, so as to lock the protrusion portion 23 of each of the hook portions 22 of the locking portion 20 to the to-be-locked portion 120. In this state, the holding portion 30 is moved from the hold releasing position P1 to the holding position P2 to restrict movement of the protrusion portion 23 of each of the hook portions 22 in the second direction B. This causes the connector 1 to be locked and held with respect to the mating connector 100 in the connected state. Note that, in general, a connector of a snap-fit connection type can be easily connected and held with respect to a mating connector as compared with a connector of a screw connection type.

When the mating connector 100 is a connector of a so-called screw connection type, with the connector main body 110 of the mating connector 100 connected to the connector main body 10, as shown in FIG. 8, the holding portion 30 is moved from the hold releasing position P1 to the fitting position P3. At this time, the holding portion 30 moves along the guide groove portion 14 of the guide portion 13 (that is, while moving in a spiral around the center line L of the connector main body 10 from the second end portion 102 of the connector main body 10 toward the first end portion 101 in the first direction A). This causes the screw groove portion 31 of the holding portion 30 to be fitted to the screw thread portion 130 of the mating connector 100 to cause the connector 1 to be fitted and held with respect to the mating connector 100 in the connected state. Note that, in general, a connector of a screw connection type can reliably maintain the connected state with respect to the mating connector as compared with a connector of a snap-fit connection type.

As described above, in the connector 1, the locking portion 20 has the plurality of hook portions 22 extending in the first direction A, arranged at intervals around the first direction A, and resiliently deformable in the second direction B intersecting the first direction A and away from the connector main body 10. Further, the holding portion 30 has a tubular shape encircling the locking portion 20 around the first direction A and has the screw groove portion 31 provided on the inner peripheral surface at the end portion adjacent to the connection portion 11 in the first direction A. The presence of the plurality of hook portions 22 makes it possible to lock and hold the connector 1 with respect to the first mating connector 100 of a snap-fit connection type in the connected state, and the presence of the screw groove portion 31 makes it possible to fit and hold the connector 1 with respect to the second mating connector 100 of a screw connection type in the connected state. That is, it is possible to realize the connector 1 with high convenience that is capable of being held with respect to not only the mating connector 100 of a snap-fit connection type but also the mating connector 100 of a screw connection type in the connected state.

Further, the holding portion 30 has the plurality of hook receiving portions 33 arranged around the first direction A and capable of receiving the plurality of hook portions 22 of the locking portion 20 at the fitting position P3. The presence of the hook receiving portions 33 makes it possible to realize the connector 1 with high convenience while reducing the size in the radial direction of the connector 1.

Further, each of the hook receiving portions 33 is configured by the opening portion extending through the holding portion 30 in the second direction. This makes it possible to realize, with a simple configuration, the connector 1 with high convenience while reducing the size in the radial direction of the connector 1.

Further, the locking portion 20 has the main body portion 21 having a ring shape and encircling the connector main body 10 around the first direction A, and the main body portion 21 is provided with the plurality of hook portions 22. This makes it possible to realize, with a simple configuration, realize the connector 1 with high convenience.

Further, each of the hook portions 22 has the protrusion portion 23 provided at the end portion in the first direction A and adjacent to the first end portion 101, extending in the second direction B and toward the connector main body 10, and capable of being locked to the to-be-locked portion 120 in the connected state where the mating connector 100 is connected to the connection portion 11, and the holding portion 30 restricts the movement of the protrusion portion 23 in the second direction B at the holding position P2 to hold the locking portion 20. This makes it possible to lock and hold, with a simple configuration, the connector 1 with respect to a plurality of mating connectors 100 different in, for example, shape of the to-be-locked portion 120 in the connected state.

The guide portion 13 is further provided at the second end portion 102 of the connector main body 10, the holding portion 30 has the guide protrusion 32 provided at the end portion in the first direction A and remote from the first end portion 101 and extending in the second direction and toward the connector main body 10, and the guide portion 13 has the guide groove portion 14 configured to receive the guide protrusion 32 to guide the holding portion 30 in the first direction A. This makes it possible to move the holding portion 30 in the first direction A with ease.

The coil spring 15 is further provided between the connection portion 11 and the guide portion 13 and pushes the holding portion 30 toward the holding position P2 in the first direction A. The presence of the coil spring 15 makes it possible to hold the holding portion 30 at the holding position P2 with ease.

Note that although the connector 1 is capable of being connected and held with respect to not only the mating connector 100 of snap-fit connection type but also the mating connector 100 of a screw connection type in the connected state, it is not limited to the configuration. The connector 1 only needs to be capable of being locked and held with respect to at least the mating connector 100 of a snap-fit connection type, and, for example, the screw groove portion 31 of the holding portion 30 may be eliminated. Such a configuration can prevent the holding portion 30 from moving to the fitting position P3 and thus eliminate the hook receiving portions 33. With the connector 1, the presence of the plurality of hook portions 22 makes it possible to lock and hold the connector 1 with respect to a plurality of mating connectors 100 of a snap-fit connection type different in, for example, shape of the to-be-locked portion 120 in the connected state and thus makes it possible to realize the connector 1 with high convenience.

Figure 9:
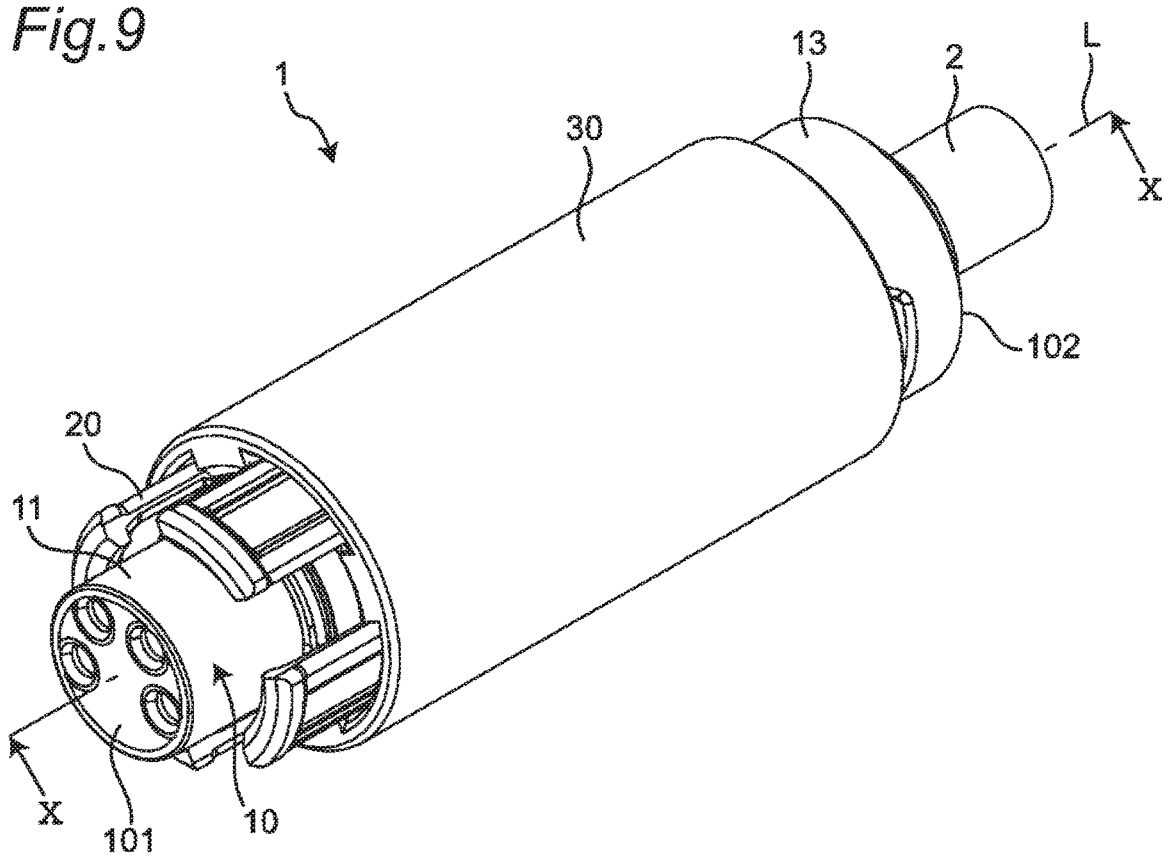
FIG. 9 is a perspective view showing a modification of the connector shown in FIG. 1.
Figure 10:
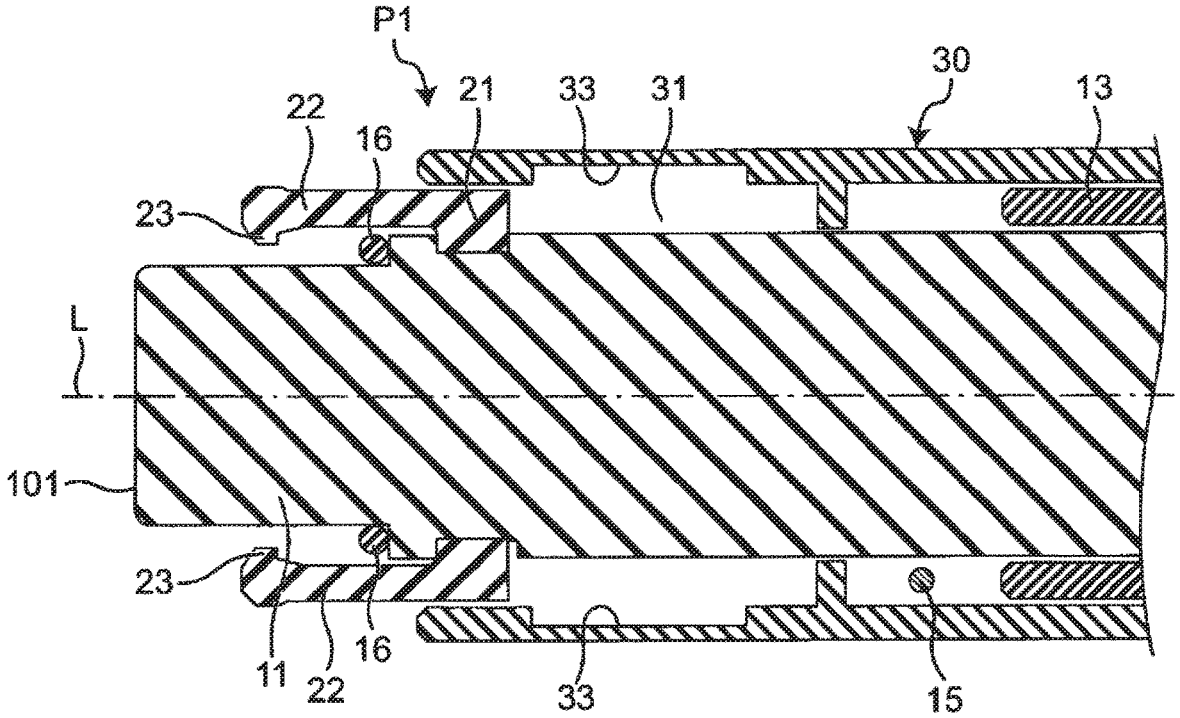
FIG. 10 is an enlarged cross-sectional view of a first end portion of a connector main body taken along a line X-X of FIG. 9.

Each of the hook receiving portions 33 only needs to form a space that allows resilient deformation of the plurality of hook portions 22 in the second direction and away from the connector main body 10, and it is not limited to the configuration where each of the hook receiving portions 33 is configured by the opening portion extending through the holding portion 30 in the second direction. For example, as shown in FIGS. 9 and 10, each of the hook receiving portions 33 may be configured by a recess portion provided on the inner peripheral surface of the holding portion 30. As described above, the configuration where each of the hook receiving portions 33 is configured by a recess portion makes it possible to increase the waterproof effect as compared with the configuration where each of the hook receiving portions 33 is configured by the opening portion.

The locking portion 20 only needs to have the plurality of hook portions 22 extending in the first direction A, arranged at intervals around the first direction A, and resiliently deformable in the second direction intersecting the first direction A and away from the connector main body 10. For example, the main body portion 21 having a ring shape may be eliminated, and each of the hook portions 22 may be directly attached to the connector main body 10.

Each of the hook portions 22 only needs to be capable of being locked to the to-be-locked portion 120 of the mating connector 100 in the first direction A in the connected state where the mating connector 100 is connected to the connection portion 11. For example, the protrusion portion 23 of each of the hook portions 22 may have any shape and size in accordance with the design of the connector 1 or the like.

The guide portion 13 may be eliminated. This configuration can further eliminate the guide protrusion 32 of the holding portion 30.

The resilient portion is not limited to the coil spring 15 and may have any configuration that can push the holding portion 30 in the first direction A toward the holding position P2. Further, the coil spring 15 may be eliminated.

Although the various embodiments of the present disclosure have been described in detail with reference to the drawings, a description will be given in conclusion of various aspects of the present disclosure. Note that the following description will be given as an example with the reference numerals attached.

A connector 1 according to a first aspect of the present disclosure capable of being locked and held with respect to a first mating connector connected in a first direction A or capable of being held and fitted with respect to a second mating connector connected in the first direction A, the connector 1 includes a connector main body 10 having a connection portion 11 extending in the first direction A, provided at a first end portion 101 in the first direction A, and capable of being connected to the first mating connector and the second mating connector, a locking portion 20 disposed at the first end portion 101 of the connector main body 10 around the first direction A and capable of being locked to a to-be-locked portion of the first mating connector in the first direction A in a connected state where the first mating connector is connected to the connection portion 11, and a holding portion 30 having a tubular shape encircling the locking portion 20 around the first direction A and moveable relative to the connector main body 10 in the first direction A, the holding portion 30 having a screw groove portion 31 provided on an inner peripheral surface at an end portion in the first direction A and adjacent to the first end portion 101 and capable of being fitted to a screw thread portion of the second mating connector in a connected state where the second mating connecter is connected to the connection portion 11, in which the locking portion 20 has a plurality of hook portions 22 extending in the first direction A, arranged at intervals around the first direction A, and capable of being locked to the to-be-locked portion through resilient deformation in a second direction B intersecting the first direction A and away from the connector main body 10, and the holding portion 30 is moveable between a holding position P2 where the holding portion 30 holds the plurality of hook portions 22 locked to the to-be-locked portion, a hold releasing position P1 that is remote from the first end portion 101 relative to the holding position P2 in the first direction A and where the holding portion 30 releases the holding of the locking portion 20, and a fitting position P3 that is adjacent to the first end portion 101 of the connector main body 10 relative to the holding position P2 in the first direction A and where the screw groove portion 31 is fitted to the screw thread portion.

With the connector 1 according to the first aspect, the presence of the plurality of hook portions 22 makes it possible to lock and hold the connector 1 with respect to the first mating connector of a snap-fit connection type in the connected state, and the presence of the screw groove portion 31 makes it possible to fit and hold the connector 1 with respect to the second mating connector of a screw connection type in the connected state. That is, it is possible to realize the connector 1 with high convenience that is capable of being held with respect to not only the mating connector of a snap-fit connection type but also the mating connector of a screw connection type in the connected state.

In the connector 1 according to a second aspect of the present disclosure, the holding portion 30 has a plurality of hook receiving portions 33 arranged around the first direction A and capable of receiving the plurality of hook portions 22 of the locking portion 20 at the fitting position P3.

With the connector 1 according to the second aspect, the presence of the hook receiving portions 33 makes it possible to realize the connector 1 with high convenience while reducing the size in the radial direction of the connector 1.

In the connector 1 according to a third aspect of the present disclosure, each of the plurality of hook receiving portions 33 forms a space that allows the plurality of hook portions 22 to resiliently deform in the second direction B and away from the connector main body 10.

With the connector 1 according to the third aspect, it is possible to realize, with a simple configuration, the connector 1 with high convenience while reducing the size in the radial direction of the connector 1.

In the connector 1 according to a fourth aspect of the present disclosure, the locking portion 20 has a main body portion 21 having a ring shape and encircling the connector main body 10 around the first direction A, and the plurality of hook portions 22 are provided on the main body portion 21.

With the connector 1 according to the fourth embodiment, it is possible to realize, with a simple configuration, the connector 1 with high convenience.

In the connector 1 according to a fifth aspect of the present disclosure, each of the hook portions 22 has a protrusion portion 23 provided at an end portion in the first direction A and adjacent to the first end portion 101, extending in the second direction B and toward the connector main body 10, and capable of being locked to the to-be-locked portion in the connected state where the mating connector is connected to the connection portion 11, and the holding portion 30 restricts movement of the protrusion portion 23 in the second direction B at the holding position P2 to hold the locking portion 20.

With the connector 1 according to the fifth aspect, it is possible to lock and hold, with a simple configuration, the connector 1 with respect to a plurality of mating connectors different in, for example, shape of the to-be-locked portion 120 in the connected state.

The connector 1 according to a sixth aspect of the present disclosure further includes, a guide portion 13 provided at a second end portion 102 on an opposite side of the connector main body 10 from the first end portion 101 in the first direction A, the holding portion 30 has a guide protrusion 32 provided at an end portion in the first direction A and remote from the first end portion 101 and extending in the second direction B and toward the connector main body 10, and the guide portion 13 has a guide groove portion 14 configured to receive the guide protrusion 32 to guide the holding portion 30 in the first direction A.

With the connector 1 according to the sixth aspect, it is possible to move the holding portion 30 in the first direction A with ease.

The connector 1 according to a seventh aspect of the present disclosure further includes a resilient portion 15 provided between the connection portion 11 and the guide portion 13 and configured to push the holding portion 30 in the first direction A toward the holding position P2.

With the connector 1 according to the seventh aspect, the presence of the resilient portion 15 makes it possible to hold the holding portion 30 at the holding position P2 with ease.

The connector 1 according to an eighth aspect of the present disclosure capable of being locked and held with respect to a mating connector connected in a first direction A, the connector 1 includes a connector main body 10 having a connection portion 11 extending in the first direction A, provided at a first end portion 101 in the first direction A, and capable of being connected to the mating connector, a locking portion 20 disposed at the first end portion 101 of the connector main body 10 around the first direction A and capable of being locked to a to-be-locked portion of the mating connector in the first direction A in a connected state where the mating connector is connected to the connection portion 11, and a holding portion 30 moveable in the first direction A relative to the connector main body 10 between a holding position P2 where the holding portion 30 is disposed on the locking portion 20 around the first direction A to hold the locking portion 20 and a hold releasing position P1 that is remote from the first end portion 101 relative to the holding position P2 in the first direction A and where the holding portion 30 releases the holding of the locking portion 20, in which the locking portion 20 has a plurality of hook portions 22 extending in the first direction A, arranged at intervals around the first direction A, and resiliently deformable in a second direction B intersecting the first direction A and away from the connector main body 10.

With the connector according to the eighth aspect, the presence of the plurality of hook portions 22 makes it possible to lock and hold the connector 1 with respect to a plurality of mating connectors 100 different in, for example, shape of a to-be-locked portion 120 in the connected state and thus makes it possible to realize the connector 1 with high convenience.

Note that suitably combining any of the various embodiments or any of the various modifications makes it possible to achieve effects possessed by each of the embodiments or the modifications. Further, combinations of the embodiments, combinations of the modifications, or combinations of the embodiments and the modifications are possible, and combinations of features in different embodiments or modifications are also possible.

While the present disclosure has been fully described in connection with the preferred embodiments with reference to the accompanying drawings, it will be apparent to those skilled in the art that various changes and modifications may be made. Unless such changes and modifications depart from the scope of the present disclosure as set forth in the accompanying claims, the changes and modifications should be construed as being included within the scope of the present disclosure.

INDUSTRIAL APPLICABILITY

The connector according to the present disclosure is applicable to, for example, a machine tool for automobile.

DESCRIPTION OF REFERENCE SIGNS

1. connector
2. cable
10. connector main body

101. first end portion
102. second end portion
11. connection portion
12. terminal receiving portion
13. guide portion
14, guide groove portion
15. coil spring
16. O-ring
20. locking portion
21. main body portion
22. hook portion
23. protrusion portion
30. holding portion
31. screw groove portion
32. guide protrusion
33. hook receiving portion
A. first direction
B. second direction
P1. hold releasing position
P2. holding position
P3. fitting position
L. center line

The invention claimed is:

1. A connector capable of being locked and held with respect to a first mating connector connected in a first direction or capable of being held and fitted with respect to a second mating connector connected in the first direction, the connector comprising:

a connector main body having a connection portion extending in the first direction, provided at a first end portion in the first direction, and capable of being connected to the first mating connector and the second mating connector;

a locking portion disposed at the first end portion of the connector main body around the first direction and capable of being locked to a to-be-locked portion of the first mating connector in the first direction in a connected state where the first mating connector is connected to the connection portion; and a holding portion having a tubular shape encircling the locking portion around the first direction and moveable relative to the connector main body in the first direction, the holding portion having a screw groove portion provided on an inner peripheral surface at an end portion in the first direction and adjacent to the first end portion and capable of being fitted to a screw thread portion of the second mating connector in a connected state where the second mating connecter is connected to the connection portion, wherein the locking portion comprises a plurality of hook portions extending in the first direction, arranged at intervals around the first direction, and capable of being locked to the to-be-locked portion through resilient deformation in a second direction intersecting the first direction and away from the connector main body, the holding portion is moveable between a holding position where the holding portion holds the plurality of hook portions locked to the to-be-locked portion, a hold releasing position that is remote from the first end portion relative to the holding position in the first direction and where the holding portion releases the holding of the locking portion, and a fitting position that is adjacent to the first end portion of the connector main body relative to the holding position in the first direction and where the screw groove portion is fitted to the screw thread portion, each of the hook portions comprise a protrusion portion provided at an end portion in the first direction and adjacent to the first end portion, extending in the second direction and toward the connector main body, and capable of being locked to the to-be-locked portion in a connected state where the mating connector is connected to the connection portion, and the holding portion restricts movement of the protrusion portion in the second direction at the holding position to hold the locking portion.

2. The connector according to claim 1, wherein the holding portion comprises a plurality of hook receiving portions arranged around the first direction and capable of receiving the plurality of hook portions of the locking portion at the fitting position.

3. The connector according to claim 2, wherein each of the plurality of hook receiving portions forms a space that allows the plurality of hook portions to resiliently deform in the second direction and away from the connector main body.

4. The connector according to claim 1, wherein the locking portion comprises a main body portion having a ring shape and encircling the connector main body around the first direction, and the plurality of hook portions are provided on the main body portion.

5. The connector according to claim 1, further comprising:

a guide portion provided at a second end portion on an opposite side of the connector main body from the first end portion in the first direction, wherein the holding portion comprises a guide protrusion provided at an end portion in the first direction and remote from the first end portion and extending in the second direction and toward the connector main body, and the guide portion comprises a guide groove portion configured to receive the guide protrusion to guide the holding portion in the first direction.

6. The connector according to claim 5, further comprising:

a resilient portion provided between the connection portion and the guide portion and configured to push the holding portion in the first direction toward the holding position.

7. A connector capable of being locked and held with respect to a mating connector connected in a first direction, the connector comprising:

a connector main body having a connection portion extending in the first direction, provided at a first end portion in the first direction, and capable of being connected to the mating connector;

a locking portion disposed at the first end portion of the connector main body around the first direction and capable of being locked to a to-be-locked portion of the mating connector in the first direction in a connected state where the mating connector is connected to the connection portion, and a holding portion moveable in the first direction relative to the connector main body between a holding position where the holding portion is disposed on the locking portion around the first direction to hold the locking portion and a hold releasing position that is remote from the first end portion relative to the holding position in the first direction and where the holding portion releases the holding of the locking portion, wherein the locking portion comprises a plurality of hook portions extending in the first direction, arranged at intervals around the first direction, and resiliently deformable in a second direction intersecting the first direction and away from the connector main body, each of the hook portions comprise a protrusion portion provided at an end portion in the first direction and adjacent to the first end portion, extending in the second direction and toward the connector main body, and capable of being locked to the to-be-locked portion in a connected state where the mating connector is connected to the connection portion, and the holding portion restricts movement of the protrusion portion in the second direction at the holding position to hold the locking portion.

* * * * *